US011078007B2

(12) United States Patent
Chase et al.

(10) Patent No.: US 11,078,007 B2
(45) **Date of Patent: *Aug. 3, 2021**

(54) THERMOPLASTIC PACKAGING INSULATION PRODUCTS AND METHODS OF MAKING AND USING SAME

(71) Applicant: Cellulose Material Solutions, LLC, Jenison, MI (US)

(72) Inventors: Kevin Chase, Hudsonville, MI (US); Brandon Fenske, Grand Rapids, MI (US); Christopher Benner, Ada, MI (US); Matthew Henderson, Jenison, MI (US)

(73) Assignee: Cellulose Material Solutions, LLC, Jenison, MI (US)

( * ) Notice: Subject to any disclaimer, the term of this patent is extended or adjusted under 35 U.S.C. 154(b) by 706 days.

This patent is subject to a terminal disclaimer.

(21) Appl. No.: 15/194,364

(22) Filed: Jun. 27, 2016

(65) Prior Publication Data

US 2017/0369226 A1 Dec. 28, 2017

(51) Int. Cl.
*B65D 81/38* (2006.01)

(52) U.S. Cl.
CPC ..... *B65D 81/3848* (2013.01)

(58) Field of Classification Search
CPC .. B65D 81/3848; B65D 81/386; B32B 27/06; E04B 1/767; E04B 1/78; E04D 13/16; E04D 13/1625
USPC ..... 220/592.2
See application file for complete search history.

(56) References Cited

U.S. PATENT DOCUMENTS

| | | | |
|---|---|---|---|
| 3,222,243 | A | 12/1965 | Gaston et al. |
| 3,461,026 | A | 8/1969 | Schick |
| 3,952,073 | A | 4/1976 | Isaka et al. |
| 3,964,235 | A | 6/1976 | Miller et al. |
| 3,987,752 | A | 10/1976 | Miller |
| 4,035,216 | A | 7/1977 | Immel |
| 4,040,847 | A | 8/1977 | Miller |
| 4,045,515 | A | 8/1977 | Isaka et al. |
| 4,083,490 | A | 4/1978 | Cunningham et al. |
| 4,094,130 | A | 6/1978 | Kelly et al. |

(Continued)

FOREIGN PATENT DOCUMENTS

| | | |
|---|---|---|
| WO | 0210524 | 2/2002 |
| WO | 2011143664 | 11/2011 |

OTHER PUBLICATIONS

Thermopod, Pie and Cake Shipper, www.thermopodllc.com/piecakeshipper.html.

(Continued)

*Primary Examiner* — King M Chu
(74) *Attorney, Agent, or Firm* — Mitchell Intellectual Property Law, PLLC

(57) ABSTRACT

Packaging insulation for insertion into a packaging container, which includes an air laid thermoplastic fibrous batt having foldable thermoplastic film material adhered to both sides of the batt. Preferably the thermoplastic material of which the fibers and film are made is the same, and most preferably it is PET. The resulting method and product provides packaging insulation which can be shipped flat and compressed, which expands when unpacked and which can be readily folded to match the interior configuration of a shipping container, such as a cardboard box.

24 Claims, 3 Drawing Sheets

(56) References Cited

U.S. PATENT DOCUMENTS 4,099,363 A 7/1978 Wistinghausen et al.
4,111,828 A 9/1978 Wang
4,172,749 A 10/1979 Liggett
4,210,530 A 7/1980 Etzel et al.
4,235,060 A 11/1980 Wang et al.
4,337,666 A 7/1982 Bhattacharyya et al.
4,341,003 A 7/1982 Kopena
4,387,021 A 6/1983 Davis et al.
4,427,153 A 1/1984 Schaefer
4,452,848 A 6/1984 Geiger
4,456,208 A 6/1984 MacConochie et al.
4,501,107 A 2/1985 Piotrowski
4,550,550 A 11/1985 Scott
4,622,346 A 11/1986 DiGiulio
4,626,554 A 12/1986 DiGiulio
4,652,609 A 3/1987 DiGiulio
4,653,397 A 3/1987 Gray et al.
4,654,375 A 3/1987 Malwitz
4,659,600 A 4/1987 DiGiulio
4,659,745 A 4/1987 DiGiulio
4,661,386 A 4/1987 DiGiulio
4,661,564 A 4/1987 DiGiulio
4,665,103 A 5/1987 DiGiulio
4,670,513 A 6/1987 DiGiulio
4,675,363 A 6/1987 DiGiulio
4,679,122 A 7/1987 Belke, Jr. et al.
4,686,240 A 8/1987 Bailey, Jr. et al.
4,701,474 A 10/1987 Bailey, Jr. et al.
4,757,108 A 7/1988 Walisser
4,762,229 A 8/1988 Wickre
4,794,358 A 12/1988 Steingroever et al.
4,797,010 A 1/1989 Coelho
4,890,165 A 12/1989 Miyagawa et al.
4,896,476 A 1/1990 Harris
4,952,441 A 8/1990 Bose et al.
5,001,017 A 3/1991 Alhamad et al.
5,004,159 A 4/1991 Kistner
5,005,765 A 4/1991 Kistner
5,051,452 A 9/1991 Romesberg
5,060,370 A 10/1991 Scales, Jr. et al.
5,094,775 A 3/1992 Bailey, Jr.
5,095,054 A 3/1992 Lay et al.
5,095,597 A 3/1992 Alhamad et al.
5,097,907 A 3/1992 Alhamad et al.
5,112,462 A 5/1992 Swisher
5,113,892 A 5/1992 Hull et al.
5,118,555 A 6/1992 Horovi
5,133,834 A 7/1992 Capps
5,137,791 A 8/1992 Swisher
5,142,755 A 9/1992 Alhamad et al.
5,206,082 A 4/1993 Malone
5,207,756 A 5/1993 Alhamad et al.
5,226,269 A 7/1993 Stoltenberg
5,226,557 A 7/1993 Nelson
5,242,115 A 9/1993 Brown
5,288,764 A 2/1994 Rotter et al.
5,297,416 A 3/1994 Alhamad et al.
5,308,560 A 5/1994 Bibby et al.
5,322,181 A 6/1994 Nelson
5,340,846 A 8/1994 Rotter et al.
5,350,063 A 9/1994 Berdan, II
5,360,848 A 11/1994 Kuechler et al.
5,364,707 A 11/1994 Swisher
5,366,594 A 11/1994 Capps
5,373,028 A 12/1994 McAfee et al.
5,374,914 A 12/1994 Prueitt
5,402,852 A 4/1995 Alhamad et al.
5,414,200 A 5/1995 Mouk et al.
5,418,031 A * 5/1995 English ..... B32B 27/12 428/74
5,429,308 A 7/1995 Brown
5,431,992 A 7/1995 Houpt et al.
5,446,111 A 8/1995 Rotter et al.
5,466,504 A 11/1995 Gavin et al.
5,470,890 A 11/1995 House et al.
5,480,730 A 1/1996 Swisher
5,497,627 A 3/1996 Heyduk et al.
5,510,419 A 4/1996 Burgoyne et al.
5,512,346 A 4/1996 Johnson
5,516,580 A 5/1996 Frenette et al.
5,525,278 A 6/1996 Krosch et al.
5,536,550 A 7/1996 Houpt et al.
5,536,793 A 7/1996 Rotter et al.
5,554,238 A 9/1996 English
5,556,926 A 9/1996 Rotter et al.
5,559,278 A 9/1996 Mouk et al.
5,575,339 A 11/1996 Alhamad
5,582,905 A 12/1996 Beck et al.
5,602,295 A 2/1997 Abel et al.
5,616,821 A 4/1997 Mouk et al.
5,618,327 A 4/1997 Aschenbeck et al.
5,620,497 A 4/1997 Aschenbeck et al.
5,620,664 A 4/1997 Palmer
5,629,089 A 5/1997 Berdan, II et al.
5,642,601 A 7/1997 Thompson, Jr. et al.
5,646,908 A 7/1997 Aschenbeck et al.
5,647,883 A 7/1997 Houpt et al.
5,672,414 A 9/1997 Okamoto et al.
5,672,429 A 9/1997 Berdan, II et al.
5,678,231 A 10/1997 Mouk et al.
5,698,750 A 12/1997 Mouk et al.
5,723,216 A 3/1998 Houpt et al.
5,733,478 A 3/1998 Creech et al.
5,738,175 A 4/1998 Alhamad
5,743,932 A 4/1998 Houpt et al.
5,755,851 A 5/1998 Scott et al.
5,770,300 A 6/1998 Okamoto et al.
5,770,309 A 6/1998 Houpt et al.
5,805,431 A 9/1998 Joshi et al.
5,816,332 A 10/1998 Alhamad
5,821,605 A 10/1998 Hong et al.
5,832,696 A 11/1998 Nagy et al.
5,843,764 A 12/1998 Woodward
5,849,131 A 12/1998 Shaffer et al.
5,883,330 A 3/1999 Yoshida
5,894,127 A 4/1999 Dando et al.
5,916,393 A 6/1999 Shaffer et al.
5,930,117 A 7/1999 Gengel
5,998,877 A 12/1999 Ohuchi
6,026,646 A * 2/2000 Hansen ..... B60N 3/104 220/6
6,033,769 A 3/2000 Brueggemann et al.
6,060,175 A 5/2000 Swisher
6,062,316 A 5/2000 Alhamad
6,066,887 A 5/2000 Hong et al.
6,089,325 A 7/2000 Alhamad
6,117,062 A 9/2000 Alhamad
6,136,878 A 10/2000 Free et al.
6,187,615 B1 2/2001 Kim et al.
6,189,344 B1 2/2001 Aschenbeck et al.
6,191,057 B1 * 2/2001 Patel ..... B32B 27/06 442/398
6,221,478 B1 4/2001 Kammeyer
6,221,925 B1 4/2001 Constant et al.
6,239,187 B1 5/2001 Hatke et al.
6,321,507 B1 11/2001 Copeland et al.
6,345,776 B1 2/2002 Hurray et al.
6,349,774 B2 2/2002 Alhamad
6,373,294 B1 4/2002 Bentley
6,375,096 B1 4/2002 Rashidi
6,388,404 B1 5/2002 Schnebly et al.
6,393,807 B2 5/2002 Tipton et al.
6,397,566 B1 6/2002 Tipton et al.
6,401,438 B2 6/2002 Tipton et al.
6,407,225 B1 6/2002 Mang et al.
6,471,061 B1 10/2002 Teague et al.
6,476,465 B2 11/2002 Hirose
6,476,481 B2 11/2002 Woodworth et al.
6,483,186 B1 11/2002 Hsieh et al.
6,502,373 B1 1/2003 Tipton et al.
6,521,979 B1 2/2003 You
6,527,203 B2 3/2003 Hurray et al.
6,528,443 B1 3/2003 Healy
6,555,491 B1 4/2003 Healy

(56) References Cited

U.S. PATENT DOCUMENTS 6,562,173 B1 5/2003 Collison
6,566,783 B2 5/2003 Hatz et al.
6,570,469 B2 5/2003 Nathanson et al.
6,667,547 B2 12/2003 Woodworth et al.
6,674,255 B2 1/2004 Schnebly et al.
6,688,757 B2 2/2004 Kovach et al.
6,699,563 B1 3/2004 Athamad
6,710,494 B2 3/2004 Hatz et al.
6,737,775 B2 5/2004 Hatz et al.
6,759,446 B2 7/2004 Lee et al.
6,809,937 B2 10/2004 Augustin et al.
6,815,380 B2 11/2004 Snyder
6,821,131 B2 11/2004 Suzuki et al.
6,840,462 B2 1/2005 Hurray et al.
6,861,821 B2 3/2005 Masumoto et al.
6,875,486 B2 4/2005 Miller
6,875,637 B2 4/2005 Yoshino et al.
6,894,374 B2 5/2005 Yoshino et al.
6,900,537 B2 5/2005 Sridevan
6,931,823 B2 8/2005 Forte et al.
6,943,433 B2 9/2005 Kamada
6,986,229 B2 1/2006 Collison
7,026,365 B2 4/2006 Lee et al.
7,026,635 B2 4/2006 Rangwalla et al.
7,046,584 B2 5/2006 Sorrells et al.
7,060,148 B2 6/2006 Toas et al.
7,070,831 B2 7/2006 You
7,077,634 B2 7/2006 Munch et al.
7,080,545 B2 7/2006 Dimeo, Jr. et al.
7,094,192 B2 8/2006 Schoenberger et al.
7,185,423 B2 3/2007 Augustin et al.
7,201,012 B2 4/2007 Munch et al.
7,201,214 B2 4/2007 Munch et al.
7,229,677 B2 6/2007 Miller
7,243,479 B2 7/2007 Allwein
7,243,484 B2 7/2007 Allwein
7,250,205 B1 7/2007 Suda et al.
7,278,549 B2 10/2007 Munch et al.
7,281,622 B2 10/2007 Qi
7,296,460 B2 11/2007 Dimeo, Jr. et al.
7,297,384 B2 11/2007 Crowley
7,334,384 B2 2/2008 Nissen
7,344,363 B2 3/2008 Munch et al.
7,348,580 B2 3/2008 Rangwalla et al.
7,365,292 B2 4/2008 Cole et al.
RE40,380 E 6/2008 Forte et al.
7,402,029 B2 7/2008 Munch et al.
7,409,813 B2 8/2008 Qi et al.
7,448,494 B2 11/2008 LaSalle
7,449,232 B2 11/2008 Rangwalla
7,453,153 B2 11/2008 Saita et al.
7,458,235 B2 12/2008 Beaufils et al.
7,461,496 B2 12/2008 Hasselbach et al.
7,472,551 B2 1/2009 May
7,475,588 B2 1/2009 Dimeo, Jr. et al.
7,509,788 B2 3/2009 Hasselbach et al.
7,525,238 B2 4/2009 Kubler et al.
7,531,703 B2 5/2009 Ramesh et al.
7,541,562 B2 6/2009 Cole et al.
7,579,628 B2 8/2009 Inoguchi
7,627,828 B1 12/2009 Collison et al.
7,658,989 B2 2/2010 DeSimone et al.
7,674,657 B2 3/2010 Heng et al.
7,733,107 B1 6/2010 Earth et al.
7,775,814 B1 8/2010 Bhutani
7,785,694 B2 8/2010 Muller et al.
7,807,313 B2 10/2010 Kaye et al.
7,820,069 B2 10/2010 Gosselin
7,846,987 B2 12/2010 Handa
7,859,115 B2 12/2010 Kim et al.
7,883,056 B2 2/2011 Mueller et al.
7,892,448 B2 2/2011 Gosselin
7,906,561 B2 3/2011 Hu et al.
7,918,062 B2 4/2011 Chen
7,936,054 B2 5/2011 Eom et al.
7,977,689 B2 7/2011 Inoguchi
8,018,043 B2 9/2011 Suh et al.
8,026,291 B2 9/2011 Handa et al.
8,026,584 B2 9/2011 Kim
8,049,332 B2 11/2011 Oh et al.
8,053,049 B2 11/2011 Ruid et al.
8,092,689 B2 1/2012 Gosselin
8,109,130 B2 2/2012 Dimeo, Jr. et al.
8,125,086 B2 2/2012 Jung et al.
8,173,219 B2 5/2012 Tutin et al.
8,173,454 B2 5/2012 Kim et al.
8,179,669 B2 5/2012 Huang
8,198,187 B2 6/2012 Ohno
8,209,929 B2 7/2012 Collison
8,216,898 B2 7/2012 Chen et al.
8,226,033 B2 7/2012 Koefinger et al.
8,247,480 B2 8/2012 Kaytan
8,298,865 B2 10/2012 Jung et al.
8,299,591 B2 10/2012 Oh et al.
8,309,619 B2 11/2012 Handa et al.
8,341,910 B2 1/2013 Collison
8,341,911 B2 1/2013 Collison
8,365,488 B2 2/2013 Chen
8,384,202 B2 2/2013 Hoashi et al.
8,424,262 B2 4/2013 Deblander et al.
8,440,275 B2 5/2013 Cole et al.
8,440,280 B2 5/2013 Ronzani
8,531,254 B2 9/2013 Yamaji et al.
8,587,185 B2 11/2013 Negley et al.
8,598,244 B2 12/2013 Handa et al.
8,604,659 B2 12/2013 Rieker et al.
8,614,154 B2 12/2013 Andersen
8,618,656 B2 12/2013 Oh et al.
8,703,835 B2 4/2014 Handa et al.
8,727,281 B2 5/2014 Muller et al.
8,749,049 B2 6/2014 Mo
8,784,945 B2 7/2014 Rangwalla
8,795,470 B2 8/2014 Henderson et al.
8,823,158 B2 9/2014 Oh et al.
8,828,510 B2 9/2014 Cole et al.
8,847,377 B2 9/2014 Kim et al.
8,872,319 B2 10/2014 Kim et al.
8,882,041 B2 11/2014 Mueller et al.
8,938,925 B2 1/2015 Collison
8,941,064 B2 1/2015 Akin et al.
8,987,064 B2 3/2015 Do et al.
9,056,410 B2 6/2015 Burke et al.
9,062,179 B2 6/2015 Kim et al.
9,070,691 B2 6/2015 Oh et al.
9,079,197 B2 7/2015 Bina et al.
9,136,215 B2 9/2015 Lim et al.
9,168,718 B2 10/2015 Westwood et al.
9,174,363 B2 11/2015 Paetz-Lauter et al.
9,206,909 B2 12/2015 Collison et al.
9,211,552 B2 12/2015 Gantenbein et al.
9,217,253 B2 12/2015 Collison
9,233,385 B2 1/2016 Gantenbein et al.
9,273,835 B2 3/2016 Negley et al.
2001/0005977 A1 7/2001 Tipton et al.
2001/0005978 A1 7/2001 Tipton et al.
2001/0031339 A1 10/2001 Johnson
2001/0045626 A1 11/2001 Hirose
2001/0054752 A1 12/2001 Woodworth et al.
2002/0038826 A1 4/2002 Hurray et al.
2002/0093297 A1 7/2002 Schnebly et al.
2002/0130200 A1 9/2002 Hurray et al.
2002/0136887 A1 9/2002 Penneau et al.
2002/0153791 A1 10/2002 Hatz et al.
2002/0153793 A1 10/2002 Hatz et al.
2002/0153798 A1 10/2002 Hatz et al.
2002/0168509 A1 11/2002 DeSimone et al.
2003/0001108 A1 1/2003 Rangwalla et al.
2003/0011051 A1 1/2003 Woodworth et al.
2003/0017653 A1 1/2003 Yoshino et al.
2003/0076668 A1 4/2003 Kovach et al.
2003/0093897 A1 5/2003 Augustin et al.
2003/0102548 A1 6/2003 You
2003/0131935 A1 7/2003 Dyne
2003/0157314 A1 8/2003 Penneau et al.

(56) References Cited

U.S. PATENT DOCUMENTS

2003/0168720 A1 9/2003 Kamada
2003/0180582 A1 9/2003 Masumoto et al.
2003/0205832 A1 11/2003 Lee et al.
2004/0016212 A1 1/2004 Miller
2004/0018340 A1 1/2004 Alhamad
2004/0067182 A1 4/2004 Kelly et al.
2004/0070068 A1 4/2004 Yoshino et al.
2004/0074285 A1 4/2004 Dimeo, Jr. et al.
2004/0081727 A1 4/2004 Kelly et al.
2004/0089820 A1 5/2004 Rangwalla et al.
2004/0094980 A1 5/2004 Armbrust et al.
2004/0104449 A1 6/2004 Yoon et al.
2004/0112093 A1 6/2004 Beaufils et al.
2004/0130021 A1 7/2004 Sridevan
2004/0137767 A1 7/2004 Suzuki et al.
2004/0148959 A1 8/2004 Munch et al.
2005/0004243 A1 1/2005 Lee et al.
2005/0007887 A1 1/2005 Sorrells et al.
2005/0022375 A1 2/2005 Augustin et al.
2005/0044815 A1 3/2005 Forte et al.
2005/0058790 A1 3/2005 Simon et al.
2005/0070617 A1 3/2005 Harfmann
2005/0158521 A1 7/2005 Sanyal
2005/0170726 A1 8/2005 Brunson et al.
2005/0173060 A1 8/2005 Toas et al.
2005/0183443 A1 8/2005 Munch et al.
2005/0183444 A1 8/2005 Munch et al.
2005/0183445 A1 8/2005 Munch et al.
2005/0183845 A1 8/2005 Munch et al.
2005/0199496 A1 9/2005 Dimeo, Jr. et al.
2005/0205424 A1 9/2005 Dimeo, Jr. et al.
2005/0205565 A1 9/2005 Cole et al.
2005/0210913 A1 9/2005 Munch et al.
2005/0214512 A1 9/2005 Fascio
2005/0230258 A1 10/2005 Dimeo, Jr. et al.
2005/0233121 A1 10/2005 Rangwalla
2005/0249910 A1 11/2005 Campal et al.
2005/0260368 A1 11/2005 Ruid et al.
2005/0260383 A1 11/2005 Yassin Alhamad
2006/0003057 A1 1/2006 Kelly et al.
2006/0052466 A1 3/2006 Handa
2006/0059852 A1 3/2006 Toas et al.
2006/0074372 A1 4/2006 Haga et al.
2006/0083281 A1 4/2006 Inoguchi
2006/0134470 A1 6/2006 Kaye et al.
2006/0147696 A1 7/2006 Crowley
2006/0196792 A1* 9/2006 Barth ..... B65D 31/02 206/320
2006/0211782 A1 9/2006 Handa et al.
2006/0238961 A1 10/2006 Saita et al.
2006/0261304 A1 11/2006 Muthukumaran et al.
2006/0270761 A1 11/2006 Gosselin
2006/0284014 A1 12/2006 Muller et al.
2006/0286325 A1 12/2006 Swoboda et al.
2006/0288661 A1 12/2006 Allwein
2007/0001564 A1 1/2007 Park
2007/0003733 A1 1/2007 Muller
2007/0018042 A1 1/2007 Muller et al.
2007/0036961 A1 2/2007 LaSalle
2007/0045567 A1 3/2007 Rangwalla et al.
2007/0083068 A1 4/2007 Ramesh et al.
2007/0095022 A1 5/2007 Nissen
2007/0107386 A1 5/2007 Allwein
2007/0157565 A1 7/2007 Qi et al.
2007/0180797 A1 8/2007 Hasselbach et al.
2007/0193224 A1 8/2007 Hasselbach et al.
2007/0195852 A1 8/2007 Clark et al.
2007/0199800 A1 8/2007 Qi
2007/0208094 A1 9/2007 Handa et al.
2007/0213416 A1 9/2007 Handa et al.
2007/0228396 A1 10/2007 Sumitani
2007/0232707 A1 10/2007 Benitsch et al.
2007/0283648 A1 12/2007 Chen
2007/0293593 A1 12/2007 Harfmann
2008/0014402 A1 1/2008 Tomich
2008/0032077 A1 2/2008 Crowley
2008/0032114 A1 2/2008 Squires et al.
2008/0047958 A1 2/2008 Cole et al.
2008/0081095 A1 4/2008 Cole et al.
2008/0110203 A1 5/2008 May
2008/0115460 A1 5/2008 Ruid et al.
2008/0121836 A1 5/2008 Bowman et al.
2008/0136110 A1 6/2008 He
2008/0138526 A1 6/2008 Tutin et al.
2008/0142380 A1 6/2008 Unruh et al.
2008/0146686 A1 6/2008 Handa
2008/0157433 A1 7/2008 Heng et al.
2008/0163565 A1 7/2008 Toas
2008/0164619 A1 7/2008 Lee et al.
2008/0190119 A1 8/2008 Smayling
2008/0203854 A1 8/2008 Kubler et al.
2008/0263997 A1 10/2008 Kinne et al.
2008/0265410 A1 10/2008 Chang et al.
2008/0281009 A1 11/2008 He et al.
2008/0281010 A1 11/2008 Lefas et al.
2009/0035479 A1 2/2009 Rangwalla
2009/0044928 A1 2/2009 Upadhya et al.
2009/0102037 A1 4/2009 Kim
2009/0130377 A1 5/2009 Samanta et al.
2009/0166836 A1 7/2009 Kim et al.
2009/0166892 A1 7/2009 Lee
2009/0174044 A1 7/2009 Eom et al.
2009/0193761 A1 8/2009 Hasselbach et al.
2009/0224392 A1 9/2009 Suh et al.
2009/0230138 A1 9/2009 Williams et al.
2009/0230244 A1 9/2009 Kofinger et al.
2009/0278155 A1 11/2009 Inoguchi
2009/0294972 A1 12/2009 Jung et al.
2009/0304999 A1 12/2009 Fascio
2009/0305427 A1 12/2009 Dimeo, Jr. et al.
2009/0313945 A1 12/2009 Unruh et al.
2010/0028649 A1 2/2010 Trouilhet et al.
2010/0029879 A1 2/2010 Gosselin
2010/0044907 A1 2/2010 Burke et al.
2010/0065206 A1 3/2010 Romes
2010/0072598 A1 3/2010 Oh et al.
2010/0101974 A1* 4/2010 Eskenazi ..... B65D 25/101 206/591
2010/0109140 A1 5/2010 Oh et al.
2010/0117208 A1 5/2010 Kim et al.
2010/0129966 A1 5/2010 Chen et al.
2010/0144962 A1 6/2010 Jana et al.
2010/0181658 A1 7/2010 Yamashita
2010/0216919 A1 8/2010 Kaytan
2010/0221908 A1 9/2010 Ohno
2010/0265985 A1 10/2010 Clark et al.
2010/0266818 A1 10/2010 Westwood et al.
2010/0266824 A1 10/2010 Westwood et al.
2010/0267914 A1 10/2010 Westwood et al.
2010/0297416 A1 11/2010 Kumar et al.
2010/0310798 A1 12/2010 Lasalle et al.
2010/0314397 A1 12/2010 Williams et al.
2010/0320323 A1 12/2010 Mueller et al.
2010/0321878 A1 12/2010 Huang
2011/0020717 A1 1/2011 Kaye et al.
2011/0039089 A1 2/2011 El Bounia et al.
2011/0057346 A1 3/2011 Nunn
2011/0081529 A1 4/2011 Richeson et al.
2011/0085581 A1 4/2011 Clark et al.
2011/0089558 A1 4/2011 Muto et al.
2011/0090933 A1 4/2011 Gibbs et al.
2011/0109120 A1 5/2011 Bonerb
2011/0114513 A1 5/2011 Kelly
2011/0140143 A1 6/2011 Kim et al.
2011/0180490 A1 7/2011 Gosselin
2011/0209780 A1 9/2011 Gantenbein et al.
2011/0210442 A1 9/2011 Lim et al.
2011/0219716 A1 9/2011 Chen
2011/0221546 A1 9/2011 Yamaji et al.
2011/0233796 A1 9/2011 Kim et al.
2011/0248374 A1 10/2011 Akin et al.
2011/0274901 A1 11/2011 Ronzani
2011/0287584 A1 11/2011 Suh et al.
2012/0013016 A1 1/2012 Oh et al.

(56) References Cited

U.S. PATENT DOCUMENTS

2012/0118495 A1 5/2012 Jung et al.
2012/0135169 A1 5/2012 Tangelder et al.
2012/0139090 A1 6/2012 Kim et al.
2012/0145568 A1* 6/2012 Collison ..... B65D 27/16 206/204
2012/0146503 A1 6/2012 Negley et al.
2012/0273947 A1 11/2012 Mo
2012/0299169 A1 11/2012 Kim et al.
2012/0299199 A1 11/2012 Kim et al.
2013/0011647 A1 1/2013 Handa et al.
2013/0011648 A1 1/2013 Handa et al.
2013/0020434 A1 1/2013 Muller et al.
2013/0026651 A1 1/2013 Oh et al.
2013/0040125 A1 2/2013 Eberstaller et al.
2013/0059938 A1 3/2013 Paetz-Lauter et al.
2013/0122255 A1 5/2013 Chen
2013/0170175 A1 7/2013 Negley et al.
2013/0170176 A1 7/2013 Athalye
2013/0221012 A1 8/2013 Cole et al.
2013/0310829 A1 11/2013 Cohen
2013/0317238 A1 11/2013 Mohanty et al.
2014/0023819 A1 1/2014 Pritchard
2014/0034756 A1 2/2014 Gantenbein et al.
2014/0043804 A1 2/2014 Negley et al.
2014/0048560 A1 2/2014 Bina et al.
2014/0084045 A1 3/2014 Yang et al.
2014/0087109 A1 3/2014 Huang et al.
2014/0107240 A1 4/2014 Donnelly
2014/0127430 A1 5/2014 Deno et al.
2014/0187658 A1 7/2014 Handa et al.
2014/0197548 A1 7/2014 Do et al.
2014/0275301 A1 9/2014 Ahmed et al.
2014/0276494 A1 9/2014 Cisko et al.
2014/0285208 A1 9/2014 Mizuta et al.
2014/0332946 A1 11/2014 Oh et al.
2014/0336319 A1 11/2014 Kim et al.
2014/0339320 A1 11/2014 Gantenbein et al.
2014/0339327 A1 11/2014 Gantenbein et al.
2014/0361662 A1 12/2014 Al Ahmad et al.
2014/0364663 A1 12/2014 Ramesh
2014/0371055 A1 12/2014 Ramesh
2015/0024545 A1 1/2015 Kim et al.
2015/0135620 A1 5/2015 Collison
2015/0151508 A1 6/2015 Planchard
2015/0158656 A1* 6/2015 McKinnon ..... B65D 81/3858 220/592.2
2015/0166244 A1 6/2015 Wood et al.
2015/0168329 A1 6/2015 Gunness
2015/0191291 A1 7/2015 Wood et al.
2015/0225526 A1 8/2015 Tu et al.
2015/0225538 A1 8/2015 Kim et al.
2015/0255499 A1 9/2015 Lee et al.
2015/0272664 A9 10/2015 Cohen
2015/0273741 A1 10/2015 Burke et al.
2015/0287673 A1 10/2015 Lim et al.
2015/0330576 A1 11/2015 Zhai et al.
2015/0340300 A1 11/2015 Shiramizu et al.
2015/0367985 A1 12/2015 Duisters et al.
2015/0373849 A1 12/2015 Huang et al.
2015/0377363 A1 12/2015 Collison et al.
2016/0039990 A1 2/2016 Park et al.
2016/0045841 A1 2/2016 Kaplan et al.
2016/0056358 A1 2/2016 Moosburger
2016/0060412 A1 3/2016 Barrette
2016/0074886 A1 3/2016 Gantenbein et al.
2016/0082667 A1 3/2016 Donderici
2019/0100371 A1 4/2019 Cardinale et al.

OTHER PUBLICATIONS

ThermoPod, ThermoPod Protective Packaging ThermoKeeper insulated protective packaging, www.mhpn.com/product/thermokeeper_insulated_protective_packaging/packaging.
Thermopod, Patent and Trademarks, www.thermopodllc.com/patents.html.
Thermopod search resulting in 5 results.
Thermal Packaging Products, Temperature Controlled Packaging, www.thermomailer.com.
Provisional U.S. Appl. No. 62/299,471, filed Feb. 24, 2016, entitled T-Shaped Insulation for Boxes.

* cited by examiner

THERMOPLASTIC PACKAGING INSULATION PRODUCTS AND METHODS OF MAKING AND USING SAME

FIELD OF THE INVENTION

The present invention relates to the field of packaging insulation.

PRIOR ART

Packaging insulation is used for shipping perishable items which must be kept cold during shipping. Individualized packages in which such items are shipped are lined with insulation to maintain the shipped item or items at the appropriate temperature. Current packaging insulation products comprise semi rigid expanded styrene panels, polymer bags stuffed with cotton, or Kraft paper bags stuffed with cotton.

SUMMARY OF THE INVENTION

The present invention comprises packaging insulation for insertion into a packaging container, which includes a fibrous batt comprised of thermoplastic polymer fibers, having foldable thermoplastic polymer film adhered to both sides of the batt. The resulting method and product provides packaging insulation which can be shipped flat and compressed, which expands when unpacked and which can be readily folded to match the interior configuration of a shipping container, such as a cardboard box. Preferably the same thermoplastic polymer is used for the polymer fibers and the polymer film, and preferably it is PET, and most preferably recycled and recyclable.

These and other features, advantages and objects of the invention will be more readily understood and appreciated by reference to the drawings, description of the preferred embodiments, and claims.

DESCRIPTION OF THE PREFERRED EMBODIMENTS

Figure 1:
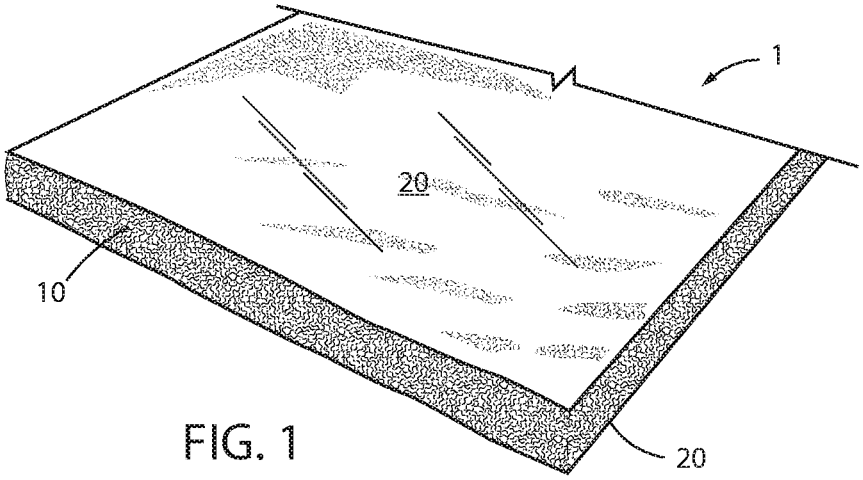
FIG. 1 is a perspective view of a preferred embodiment packaging insulation.
Figure 2:
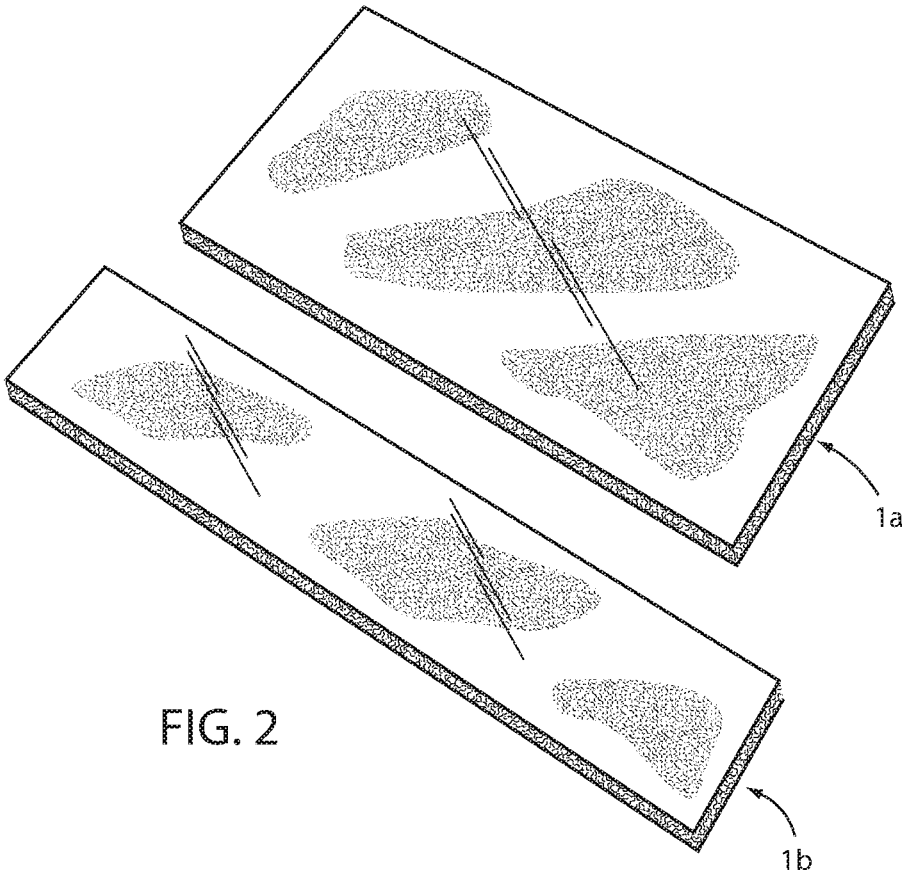
FIG. 2 is a perspective view of two pieces of packaging insulation cut to fit within a particular shipping container.
Figure 3:
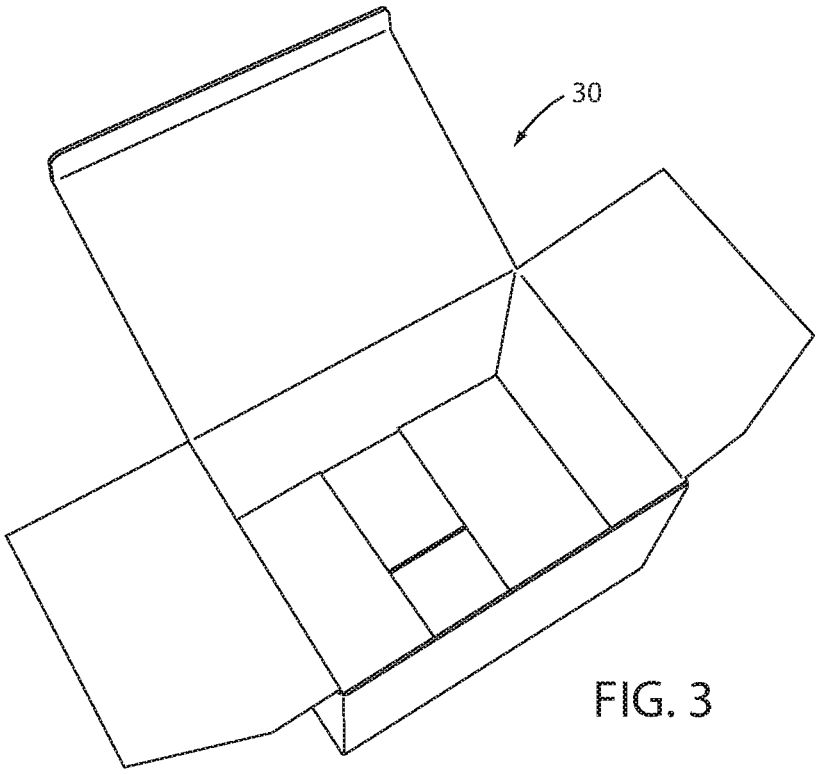
FIG. 3 is a perspective view of a cardboard shipping container without packaging insulation.
Figure 4:
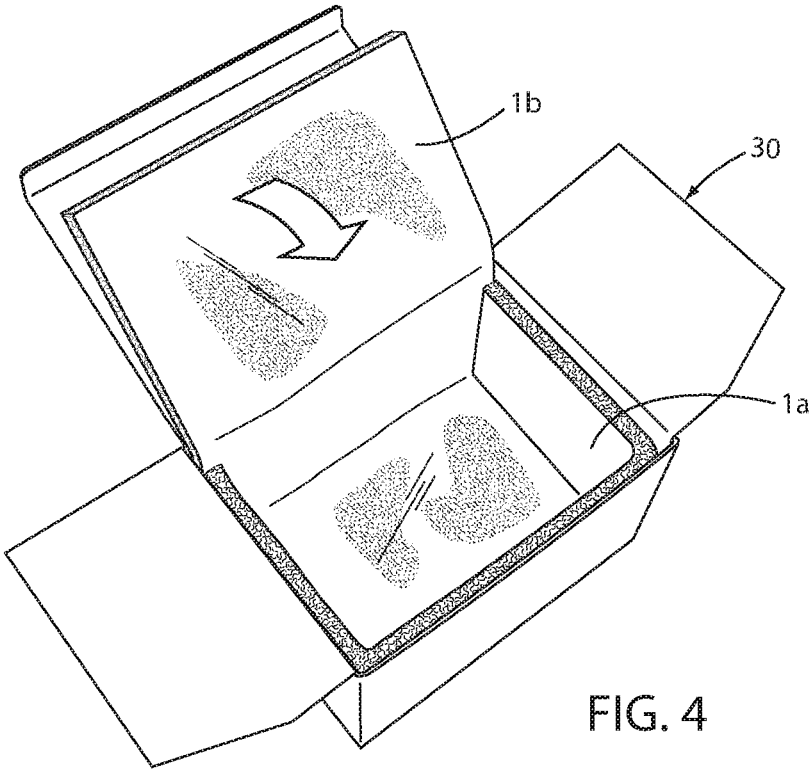
FIG. 4 is a perspective view of the container of FIG. 3 lined with the packaging insulation pieces of FIG. 2.

In the preferred embodiment, laminated packaging insulation 1 comprises a fibrous polyethylene terephthalate (PET) fiber batt 10, laminated between two layers of PET film material 20 (FIG. 1). FIG. 2 shows a sheet of the packaging insulation 1 which has been cut into pieces 1*a* and 1*b* to fit within the cardboard shipping container 30 of FIG. 3. Packaging insulation 1 is readily foldable into appropriate shipping container configurations. As shown in FIG. 4, piece 1*b* has been folded to cover the bottom, one side and the lid of container 30. Piece 1*a* has been folded to cover the remaining three sides of container 30. Preferably, the fibrous batt is non-woven, most preferably air-laid. While other thermoplastic polymers can be used for the fibers and film, preferably the same thermoplastic polymer is used for the polymer fibers and the polymer film, preferably it is PET, and most preferably recyclable and recycled. By using the same thermoplastic material for the fibers, the binder fibers and the film, the packaging insulation material may be readily recycled in commercial recycle centers. Recycled PET is the most preferable thermoplastic material.

The non-woven PET fiber batt 10 is formed of PET staple fibers, preferably fibers made from recycled PET (recycled PET fibers), having a length between 20-72 mm, preferably between 20 to 60 mm. The denier of the recycled PET fibers substantially falls between about 1 to about 10, preferably about 2 to about 8, and most preferably about 4-6 denier. Thickness of the PET fibers varies with denier, but finer fibers are preferred. From about 5 to about 30% thermoplastic binder fibers, more preferably about 10-25%, and most preferably about 15-20%, are mixed in with the PET fibers. Binder fibers may be lower melting point resinous fibers such as polyolefin, PVA or PVOH; or may be bi-component fibers including a higher melting point thermoplastic component associated with a lower melting point thermoplastic material. The bi-component fiber may comprise side by side strands of the two materials, or a higher melting point core encased in a lower melting point sheath, or a higher melting point strand with lower melting point beads scattered along its length. The binder fibers have lengths within the ranges discussed above. As above, preferably the same thermoplastic polymer is used for the polymer binder fibers, the batt fibers and the polymer film, preferably it is PET, and most preferably recycled and recyclable.

The PET film material used is preferably made from recycled PET (recycled PET film). It is preferably bi-axially oriented polyester film having a thickness of from about 2 to about 20 microns, most preferably about 12 microns. A clear PET film is preferred, having a haze of only about 3-4%. It is substantially impervious to moisture.

The PET fibers are normally shipped in bales, which are "opened" using a bale opening machine and process, which separates the fibers. They are mixed with the binder fibers and delivered by the flow of air into an air lay machine that forms a continuous batt and delivers it to a continuously moving conveyor belt. The fibers will be air laid to a thickness which is appropriate to the final thickness desired. The fibers will be air laid to a thickness which is greater than, but appropriate to the final thickness desired. A batt as air laid on the conveyor may vary widely, but from about 3 to about 6 inch thicknesses are typical. The basis weight is between about 400 gsm to about 1200 gsm (0.08 pounds/square foot to about 0.25 pound/square foot.) The batt is conveyed through an oven which is maintained at a temperature of from about from about 160 to about 185° C., typically about 165 to 175° C. The heat of the oven tackifies the sheath of the binder fibers to assist in binding the natural and binder fibers together and give the batt cohesion. The heat of the oven tackifies the sheath of the binder fibers to assist in binding the PET and binder fibers together and give the batt cohesion.

Figure 5:
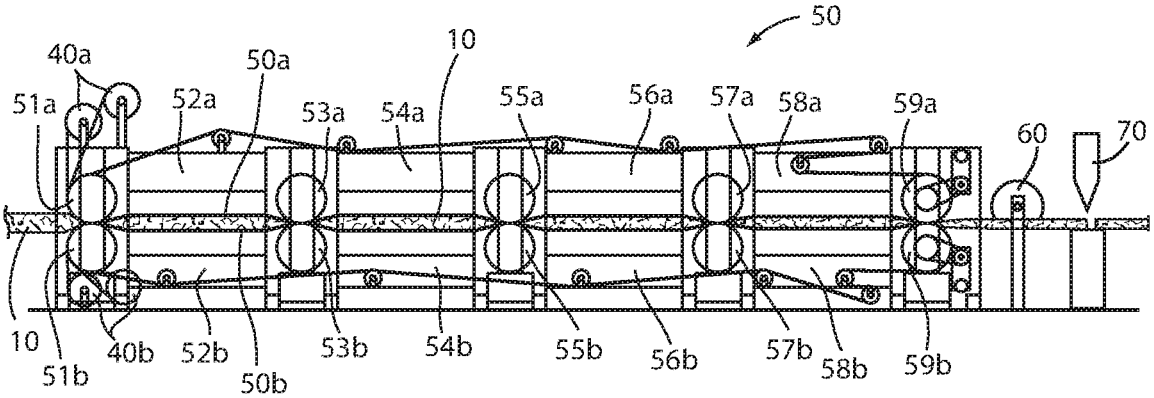
FIG. 5 is a plan view of the compression equipment used to form the packaging insulation of the preferred embodiment.
Figure 6:
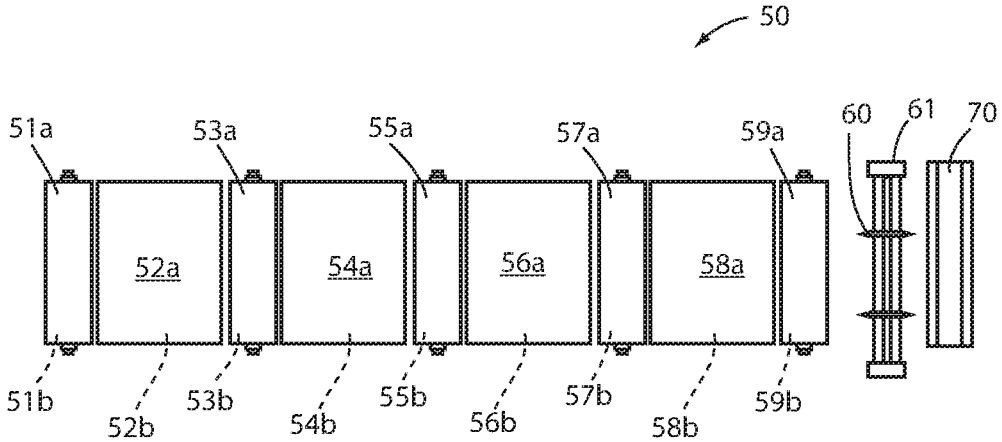
FIG. 6 is a top plan view of the compression equipment.

From the oven, the batt is conveyed along to compressor 50 (FIGS. 5 and 6). Compressor 50 comprises a series of upper and lower compression rollers 51*a-b*, 53*a-b*, 55*a-b*, 57*a-b* and 59*a-b* which respectively carry a conveyor belt 50*a* and 50*b*, made of a low friction material such as Teflon. Located between the compression rollers, are compression plates 52*a-b*, 54*a-b*, 56*a-b* and 58*a-b*, which press against the upper and lower Teflon conveyor belts 50*a* and 50*b*. The Teflon conveyor belts 50*a* and 50*b* slide over and past the compression plates.

As fibrous batt 10 is fed between the upper and lower Teflon conveyor belts 50*a* and 50*b*, at upper and lower starter rolls 51*a* and 51*b*, the PET film facing stock is fed from one of the upper rolls 40*a* under the upper Teflon conveyor belt 50*a* at top roll 51*a* and from one of the lower rolls 40*b* over the lower Teflon conveyor belt 50*b* at bottom roll 51*b* so as to be applied to both opposite sides of the passing fibrous batt 10 (FIG. 5). Two separate top feed stock rolls 40*a* can carry the same full width paper rolls and used in the alternative, or can carry paper rolls of two different widths and used in the alternative, or can carry two narrower paper rolls and used simultaneously to feed two side by side rolls of paper, which overlap slightly during the lamination process. The same is true for the two separate bottom feed stock rolls 40*b*.

The batt continues to pass between the upper and lower Teflon conveyor belts, carried by alternating upper and lower compression rollers and compression plates, which gradually reduce the thickness of the laminated batt to the target thickness. Compression rolls 51*a-b*, and 53*a-b* are heated to from about 170° C. to about 190° C., while rolls 55*a-b*, 57*a-b* and 59*a-b* are cooled to about 40° F. to about 55° F. Similarly, compression plates 52*a-b* and 54*a-b* are heated to from about 170° C. to about 190° C., while plates 56*a-b* and 58*a-b* are cooled to about 40° F. to about 55° F. In this manner, binding fibers in the fibrous batt continue to be adhering and tacky, and the PET film stock becomes heated and tacky, through the heated compression rollers and heated compression plates. When the batt reaches the cooling rollers and cooling compression plates, the heated and tacky binder fabrics and the tackified PET film stock begin to solidify and complete the adherence process, both between fibers in the batt, and between the batt and the PET film laminated to each opposing face of the batt.

As the laminated batt passes the final compression rolls 59*a* and 59*b*, it passes through longitudinal cutters 60 adjustably mounted on a support 61. This cuts the batt to desired widths. The batt so cut then passes a guillotine cutter blade 70 which cross-cuts the batt to desired lengths.

The resulting packaging insulation products 1 are cut to desired dimensions for specific packaging insulation requirements, and are from about ¼ to about 3 inches thick, and have a density of from about one to about seven pounds per cubic foot. The packaging insulation products can be shipped flat and compressed for economy of shipment. Surprisingly, the laminated PET product can be compressed to a greater degree than other types of fibrous batts used in packaging insulation, making it more economical to ship to the customer. When the laminated PET batts are unpacked at the customer's location, they expand back to at least near their original thickness, and can be folded to fit the packaging container in which product is to be shipped. Preferably, two panels are provided for each package (FIG. 2), one of which can be folded to cover the bottom, rear side and top of the container, and the other of which can be folded to cover the two ends and front side of the container (FIGS. 3 and 4).

EXAMPLE

A 1.5 inch thick all recycled PET fiber and film product, with a density of one pound/cubic foot, was assembled in a cardboard shipping container in the manner shown in FIG. 4. Each payload consisted of two 6-oz gel packs with a thermocouple on top, in between (middle), and bottom of the assembly. The assemblies were held together with duct tape.

The gel packs were placed into an environmental chamber for freezing to −18° C. at least 6 hours prior to the official initiation of the test. Concurrently the shipping container fitted with the PET insulation material conditioned to 22° C. in a separate chamber for a minimum of 24 hours.

The gel pack assemblies were placed in the shipping container and the closed container was subjected to 35° C. (95° F.) for more than 72 hours. The temperatures were logged at 15 minute intervals. The gel packs inside the container remained below 39° F. for more than 35 hours.

Of course it is understood that the above are preferred embodiments of the invention, and that various changes and alterations can be made without departing from the spirit and scope of the invention, as set forth in the appended claims.

The invention claimed is:

1. A method for insulating packaging containers comprising: providing a flat laminated packaging insulation which is of uniform thickness, resiliently compressible and foldable, cut to size for locating in a packaging container, said packaging insulation comprising an air laid thermoplastic fibrous batt comprised primarily of thermoplastic fibers, said batt being of uniform thickness, resiliently compressible and foldable, and having foldable thermoplastic film material adhered to both sides of said batt to form a laminate which can be folded without the need for creases, grooves or cut lines in said laminate to facilitate folding, whereby said laminated packaging insulation can be manufactured, compressed and shipped as a flat panel of uniform thickness, and allowed to resiliently expand and be folded for insertion into a packaging container.

2. The method of claim 1 wherein said fibrous batt includes from about 5 to about 30% thermoplastic binder fibers mixed with and adhered to at least some of said thermoplastic fibers.

3. The method of claim 2 in which said thermoplastic fibers, said thermoplastic binder fibers and said thermoplastic film are all made of the same thermoplastic polymer material, whereby said packaging insulation used may be readily commercially recycled.

4. The method of claim 3 wherein said thermoplastic material is PET.

5. The method of claim 4 wherein said thermoplastic material is recycled PET.

6. The method of claim 3 in which said fibers have lengths of between about 20 to about 72 mm.

7. The method of claim 6 in which the denier of said thermoplastic fibers is between about 1 to about 10.

8. The method of claim 7, in which the denier of said thermoplastic fibers is from about 2 to about 8.

9. The method of claim 8 in which the denier of said thermoplastic fibers is from about 4 to about 6.

10. The method of claim 4 which said PET film material is from about 2 to about 20 microns thick, and is made of recycled PET.

11. The method of claim 10 in which said thermoplastic binder fibers comprise from about 10 to about 25% of said fibers in said batt.

12. The method of claim 10 in which said thermoplastic binder fibers comprise from about 15 to about 20% of said fibers in said batt; said binder fibers comprising a higher melting point thermoplastic core fiber; encased in a lower melting point thermoplastic sheath.

13. The method of claim 1 in which said laminated packaging insulation is shipped flat and compressed for economy of shipment, and for folding to fit its intended packaging container when provided to a customer for use as packaging insulation.

14. The method of claim 13 in which two separate ones of said flat panels of said laminated packaging insulation are provided for said package container, said package container having a bottom, rear side, front side and two end sides and a top, such that one of said flat panels can be folded to cover said bottom, rear side and top of the container, and the other of which can be folded to cover said two ends and front side of the container.

15. The method of claim 13 wherein said fibrous batt includes from about 5 to about 30% thermoplastic binder fibers mixed with and adhered to at least some of said fibers, and said fibers, said binder fibers and said film are made of recycled PET.

16. The method of claim 15 in which said PET fibers have lengths of between about 20 to about 60 mm.

17. The method of claim 16 in which the denier of said PET fibers is between about 1 to about 10.

18. The method of claim 16 in which said PET film material is from about 2 to about 20 microns thick.

19. The method of claim 16 in which two separate ones of said flat panels of said laminated packaging insulation are provided for said package container, said package container having a bottom, rear side, front side and two end sides and a top, such that one of said flat panels can be folded to cover said bottom, rear side and top of the container, and the other of which can be folded to cover said two ends and front side of the container.

20. A package insulation material comprising: a flat laminated packaging insulation which is of uniform thickness, resiliently compressible and foldable, cut to size for locating in a packaging container, said packaging insulation comprising a thermoplastic fibrous batt comprised primarily of thermoplastic fibers, said batt being of uniform thickness, resiliently compressible and foldable, and having foldable thermoplastic film material adhered to both sides of said batt to form a laminate which can be folded without the need for creases, grooves or cut lines in said laminate to facilitate folding, whereby said laminated packaging insulation can be manufactured, compressed and shipped as a flat panel, and allowed to resiliently expand and be folded for insertion into a packaging container.

21. The package insulation material of claim 20 wherein said thermoplastic fibrous batt includes from about 5 to about 30% thermoplastic binder fibers mixed with and adhered to at least some of said thermoplastic fibers; said thermoplastic fibers of said fibrous batt being recycled PET fibers having lengths of between about 20 to about 60 mm, and a denier of between about 1 to about 10; said thermoplastic film material having a thickness of about 2 to about 20 microns, and is made of recycled PET.

22. The package insulation material of claim 21 comprising two separate ones of said flat panels of said laminated packaging insulation for said package container, said package container having a bottom, rear side, front side and two end sides and a top, such that one of said flat panels can be folded to cover said bottom, rear side and top of the container, and the other of which can be folded to cover said two ends and front side of the container.

23. A product shipping combination comprising: a packaging container; a flat laminated packaging insulation which is of uniform thickness, resiliently, compressible and foldable, being cut to size for folding and locating in said packaging container, said packaging insulation comprising an air laid PET fibrous batt comprised primarily of PET fibers, said batt being of uniform thickness, resiliently compressible and foldable, and having foldable PET film material adhered to both sides of said batt to form a laminate which can be folded without the need for creases, grooves or cut lines in said laminate to facilitate folding, whereby said laminated packaging insulation can be manufactured, compressed and shipped as a flat panel, allowed to resiliently expand and be folded for insertion into said packaging container; said laminated packaging insulation being folded and inserted into said packaging container.

24. The product shipping combination of claim 23 comprising; two separate ones of said flat panels of said laminated packaging insulation for said package container, said package container having a bottom, rear side, front side and two end sides and a top, such that one of said flat panels can be folded to cover said bottom, rear side and top of the container, and the other of which can be folded to cover said two ends and front side of the container.

* * * * *